US011059547B2

(12) United States Patent
Kristjansson et al.

(10) Patent No.: US 11,059,547 B2
(45) Date of Patent: Jul. 13, 2021

(54) SYSTEM ARRANGED ON A MARINE VESSEL OR PLATFORM, SUCH AS FOR PROVIDING HEAVE COMPENSATION AND HOISTING

(71) Applicant: National Oilwell Vareo Norway AS, Kristiansand S (NO)

(72) Inventors: Kristjan Kristjansson, Kristiansand (NO); David Allen Hill, Kristiansand (NO); Slawomir Kukielka, Kristiansand (NO); Steinar Bø Nilsen, Vennesla (NO)

(73) Assignee: National Oilwell Varco Norway AS

( * ) Notice: Subject to any disclaimer, the term of this patent is extended or adjusted under 35 U.S.C. 154(b) by 183 days.

(21) Appl. No.: 16/338,614

(22) PCT Filed: Oct. 3, 2017

(86) PCT No.: PCT/NO2017/050260
§ 371 (c)(1),
(2) Date: Apr. 1, 2019

(87) PCT Pub. No.: WO2018/067017
PCT Pub. Date: Apr. 12, 2018

(65) Prior Publication Data

US 2020/0039615 A1 Feb. 6, 2020

(30) Foreign Application Priority Data

Oct. 3, 2016 (EP) ..... 16192011

(51) Int. Cl.
*B63B 39/03* (2006.01)
*E21B 19/00* (2006.01)
(Continued)

(52) U.S. Cl.
CPC ..... *B63B 39/03* (2013.01); *E21B 19/006* (2013.01); *F15B 1/02* (2013.01); *B63B 35/44* (2013.01); *F04B 7/00* (2013.01)

(58) Field of Classification Search
CPC ..... B63B 39/03; B63B 35/44; E21B 19/006; F15B 1/02; F04B 7/00
(Continued)

(56) References Cited

U.S. PATENT DOCUMENTS 5,469,801 A * 11/1995 Payne ..... B63B 1/285 114/282
5,630,318 A * 5/1997 Folsom ..... F04C 14/20 60/487
(Continued)

FOREIGN PATENT DOCUMENTS

| | | |
|---|---|---|
| GB | 2456626 | 7/2009 |
| WO | WO2006123147 | 11/2006 |
| WO | WO2012066268 | 5/2012 |

OTHER PUBLICATIONS

Written Opinion for PCT/NO2017/050260 dated Feb. 12, 2018 (5 pages).
(Continued)

*Primary Examiner* — Gertrude Arthur Jeanglaude
(74) *Attorney, Agent, or Firm* — Conley Rose, P.C.

(57) ABSTRACT

A system on a marine vessel or platform supports a load while allowing heave compensation. The load is supported via a hydraulic actuator. A transformer of the system includes a power source and at least one hydraulic pump/motor, for communicating energy between any two of: the hydraulic actuator; a hydraulic accumulator; and a power source. A valve associated with the pump/motor is switchable during at least one cycle of the pump/motor for selectively providing fluid communication between a drive chamber of the pump/motor and any of the hydraulic actuator, the
(Continued)

hydraulic accumulator, and a hydraulic fluid reservoir, via at least one port of the drive chamber, so as to allow a desired displacement of hydraulic fluid from the pump/motor to be obtained.

25 Claims, 5 Drawing Sheets

(51) Int. Cl.
*F15B 1/02* (2006.01)
*B63B 35/44* (2006.01)
*F04B 7/00* (2006.01)

(58) Field of Classification Search
USPC ..... 701/21
See application file for complete search history.

(56) References Cited

U.S. PATENT DOCUMENTS

2013/0232963 A1 9/2013 Jagoda
2015/0361736 A1 12/2015 Bergan
2017/0204589 A1* 7/2017 Ohira ..... E02F 9/2075

OTHER PUBLICATIONS

International Search Report for PCT/NO2017/050260 dated Feb. 12, 2019 (10 pages).
Linjama, Adj. Prof M., et al., Digital Pump-Motor with Independent Outlets, Tampere University of Technology, The 11th Scandinavian International Conference on Fluid Power, SICFP'09, Jun. 2-4, 2009, (16 Pages).

* cited by examiner

SYSTEM ARRANGED ON A MARINE VESSEL OR PLATFORM, SUCH AS FOR PROVIDING HEAVE COMPENSATION AND HOISTING

CROSS REFERENCE TO RELATED APPLICATIONS

This application is a 35 U.S.C. § 371 national stage application of PCT/NO2017/050260 filed Oct. 3, 2017 and entitled "System Arranged on a Marine Vessel or Platform, Such as for Providing Heave Compensation and Hoisting", which claims priority to European Patent Application No. 16192011.1 filed Oct. 3, 2016, each of which is incorporated herein by reference in their entirety for all purposes.

STATEMENT REGARDING FEDERALLY SPONSORED RESEARCH OR DEVELOPMENT

Not applicable.

TECHNICAL FIELD

The present disclosure relates in particular to a system arranged to be provided on a marine vessel or platform, such as for lifting, lowering, supporting, or positioning a load and/or for providing heave compensation.

BACKGROUND

Marine vessels or platforms may be provided with means for supporting a load, for example so that the load can be lowered, lifted, or positioned in the desired manner. In the marine environment however, a challenge exists in that the vessel or platform may rise and fall with the motion of the sea, heaving upward or downward, such that it can be difficult to control the load due to the motion of the sea.

In the oil and gas exploration and production industry, hoisting rigs are provided on marine vessels or platforms for supporting very high loads such as tubing sections or strings, drilling tools, logging tools, etc., which may require to be provided on the seabed or in a wellbore. It may be sought to keep such equipment in a particular position relative to the wellbore (or seabed), or to support the equipment so that it has a certain tension or so that it applies a certain weight in the wellbore.

To this end, a heave compensation system may commonly be provided to prevent the heave motion of the vessel, e.g. upward or downward, adversely affecting the position of equipment being supported from vessel relative to the seabed or subsurface.

In the case of supporting a pipe string from a hoisting rig, the hoisting rig, in a tripping out operation, may be required to perform lifts to lift the pipe string out of the wellbore, and then support the pipe string while a section of the pipe string is removed.

In some hoisting systems on vessels, lifting has been performed by vertically oriented hydraulic lifting cylinders arranged in a derrick, where the lifting cylinders support an arrangement of sheaves, and the load is supported on a wire rope which runs over the sheaves and is connected at the other end to the vessel. The cylinder may extend or retract vertically to move the sheaves upward or downward, to lift or lower the load accordingly.

Heave compensation can be provided in various ways, including by way of a hydraulic actuator. In known vertical cylinder hoisting rigs for wellbore equipment, a dedicated heave compensating actuator may be provided on the "deadline" wire. The heave compensating actuator may operate to take account of the vessel so as to position the load while the heave motion effects are suppressed. For example, when the vessel heaves down, the actuator can be driven with hydraulic fluid to move an actuator arm to reconfigure the length of the actuator based on the amount of heave, such that equipment is held in a desired position relative to the seabed. When the vessel heaves up, the actuator arm may be moved in an opposite sense such that hydraulic fluid is expelled from the actuator and the length of actuator is reconfigured to another length based on the amount of heave, again so that the equipment can be maintained in the same position relative to the seabed.

The inventors have identified certain drawbacks with prior art systems. In particular, it is noted that today's hoisting systems for wellbore equipment and providing heave compensation can be of significant size and one of the main consumers of power and energy on a marine vessel.

In existing hoisting systems, energy recovery during lowering may be used to charge a hydraulic accumulator, and stored energy in the accumulator may be utilised in a subsequent lifting operation. While this provides some re-use of energy benefit, such systems can suffer significant losses and limitations in the efficiency.

An example prior art heave compensation system using a hydraulic heave compensating actuator is described in the published patent application WO2012/066268 (Ankargren/Pohl). The described heave compensation system has combined passive and active heave compensation functions. The system is operated using two hydraulic machines and an electric motor which are coupled to a drive shaft. In certain instances, this system provides "passive heave compensation", where the accumulator may provide the necessary power to the compensating cylinder for providing heave compensation. In other instances, when the accumulator arrangement is not sufficient, additional impetus may be needed to operate the compensating actuator for providing heave compensation. The motor may be utilised for this purpose providing "active heave compensation". Although this system of WO2012/066268 proposes a machine for transferring energy between the accumulator, the compensating actuator, and the motor, studies based on standard system design and implementation on a vessel have indicated that the benefits in efficiency of this system may be undesirably limited due to losses and may result in an undesirably large footprint. As such, the system has not to date been implemented in practice.

In particular, it can be noted that power requirements for applications such as where hoisting of well equipment is concerned can be very substantial where space availability may be at a premium. Prior art arrangements may in general also suffer from size, consumption of fuel, cost, and inefficiencies in operation and in utilisation of energy.

It is an aim of the disclosure to obviate or at least mitigate deficiencies or drawbacks associated with prior art techniques.

SUMMARY OF THE DISCLOSURE

In light of the above, according to a first aspect of the disclosure, there is provided a system arranged on a marine vessel or platform, the system comprising:

at least one hydraulic actuator coupled to a load, the actuator being configured to support the load while allowing compensation for the heave motion of the marine vessel or the platform in the sea, the load being supported via the hydraulic actuator from the marine vessel or platform;

at least one hydraulic accumulator;

at least one reservoir for hydraulic fluid;

at least one controller;

a transformer comprising at least one power source and at least one hydraulic pump/motor, for communicating energy between any two of the hydraulic actuator, the accumulator, and the power source; and at least one valve associated with the pump/motor, the valve being switchable during at least one cycle of the pump/motor for selectively providing fluid communication between a drive chamber of the pump/motor and any of the hydraulic actuator, the hydraulic accumulator, and the reservoir, via at least one port of the drive chamber, so as to allow a desired displacement of hydraulic fluid from the pump/motor to be obtained;

the valve being operable under control from the controller.

The valve may be selectively operated to enable motoring, wherein the pump/motor may be driven by either or both of the accumulator and the hydraulic actuator to apply a component of torque to a drive shaft for facilitating rotation of the drive shaft. The pump/motor when motoring may be driven by the hydraulic actuator, in an energy recovery condition, in response to lowering the load, reducing tension on the load, and/or heave upward motion.

The valve may be selectively operated to enable pumping, wherein the pump/motor may be driven to pump fluid for either or both of actuating the hydraulic actuator and charging the accumulator. The pump/motor when pumping may be performed to provide the hydraulic actuator with power to operate the hydraulic actuator for lifting the load, applying tension to the load, and/or compensating for heave downward motion.

The pump/motor may be driven by the power source and/or another pump/motor. The pump/motor may be driven via a rotatable shaft to which the power source and the pump/motors may be coupled.

In particular embodiments, the pump/motor when pumping may be driven by the power source to charge the accumulator during a pause between lifting operations in which sections of a pipe string are removed or added in a tripping in or out process. The power source may then operate at a constant level of power between the pause and the lifting operations. The energy in the charged accumulator may then be applied together with the energy from the power source to pump fluid during the lifting operations in order to obtain the required power for the actuator to perform the lifting.

The valve may be selectively operated to operate the pump/motor to circulate fluid between the reservoir and the drive chamber in an idle mode.

The reservoir may comprise hydraulic fluid contained in one or more flow line sections or receptacles, and/or in a tank or an accumulator. The reservoir may provide a sink or a source for hydraulic fluid, or both. The reservoir may be provided in a feeder circuit for making hydraulic fluid available for the system. The reservoir, and/or the fluid made available to the system, may typically have a low pressure. This may typically be to allow fluid to be expelled from and/or be supplied to the drive chamber of the pump/motor, and not for purpose of providing a source of power. In contrast, the hydraulic actuator and the hydraulic accumulator to or from which energy may be communicated via the transformer, may operate at high pressure, whereby they can be energised to provide power for handling heavy loads, such as well equipment such as tubing strings for use in a well. The high pressure (maximum) is typically two orders of magnitude higher than the low pressure.

The pump/motor may have a cycle comprising first and second strokes, wherein motoring may take place in the first stroke and pumping may take place in the second stroke.

The valve may be operated to produce pumping in part of the second stroke to obtain the desired fluid displacement and/or may be operated to produce motoring in part of the first stroke.

The pump/motor may comprise a reciprocating piston which may travel in a fixed-length linear stroke in each and every cycle.

A plurality of pump/motors may be coupled to a shaft which may cooperate to produce a desired fluid displacement wherein the at least one valve may be selectively operated to provide fluid communication between the accumulator, reservoir, or hydraulic actuator to the drive chamber of any one or more of the plurality of pump/motors for obtaining said desired displacement.

The valve may be operated to enable or disable any one or more of the pump/motors to obtain the desired fluid displacement from the plurality.

The system may further comprise:

a first line for fluid communication between the actuator and the drive chamber of the pump/motor;

a second fluid line for fluid communication between the energy storage device and the drive chamber;

a third fluid line for fluid communication between the drive chamber and the reservoir; and wherein the valve may be switchable for selectively putting any one or more of the first, second, and third fluid lines in fluid communication with the drive chamber.

By switching the valve, fluid communication through the first, second and/or third fluid lines may be opened or closed.

The switchable valve may be operated to switch during the stroke or between end points of fixed-length first and/or second strokes of the pump/motor.

The power source may typically comprise an electric motor.

Rotation of the shaft during motoring may generate electricity in the motor.

The pump/motor may comprise a piston movably mounted in a piston housing, so as to be movable reciprocally back and forth within the housing.

The system may further comprise at least one sensor. The controller may be adapted to operate based on received data from the sensor for passing an instruction to the valve for controlling the pump/motor.

The sensor may be selected from any of: a load-cell for detecting tension imparted to the load; a position sensor for detecting a position of the load; a heave motion sensor for detecting the heave motion of the vessel; an encoder for detecting a rotational position of the drive shaft.

The hydraulic actuator may comprise a vertically oriented lifting cylinder for a hoisting rig on the vessel or platform.

According to a second aspect of the disclosure, there is provided a method of supporting a load from a vessel or platform using one of the systems described above.

Any of the various aspects of the disclosure may include the further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

BRIEF DESCRIPTION OF THE DRAWINGS

There will now be described, by way of example only, embodiments of the disclosure with reference to the accompanying drawings, in which.

DETAILED DESCRIPTION OF THE DISCLOSED EXEMPLARY EMBODIMENTS

Figure 1:
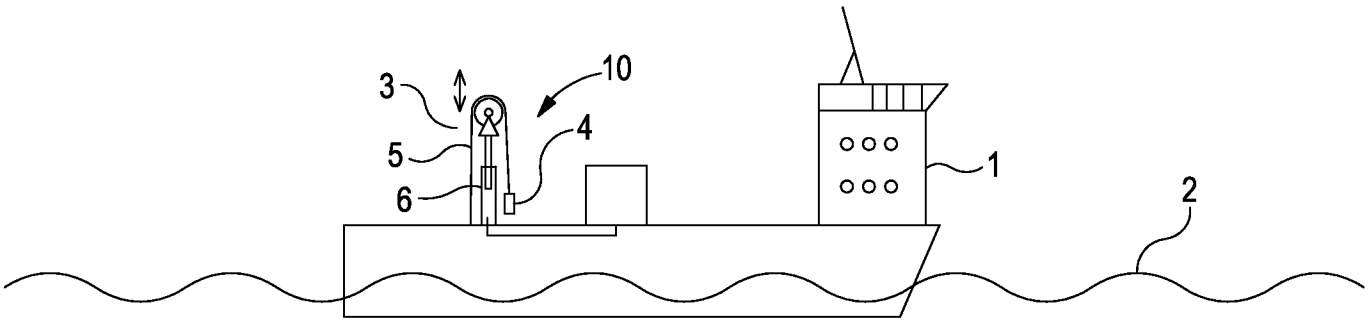
FIG. 1 is a representation of a system on a vessel according to an embodiment of the disclosure.

With reference first to FIG. 1, a system 10 is generally depicted. The system 10 is provided on a vessel 1, shown on the surface of the sea 2. In this example, the system 10 includes a hoisting rig 3 for lifting or lowering a load 4. The hoisting rig 3 comprises a hydraulic actuator 6 which may be a main lifting cylinder of the hoisting rig 3, for lifting or lowering or otherwise positioning the load 4 with respect to the vessel 1. For instance, an arm of the actuator 6 can extend or retract to change the vertical distance between the load 4 and the vessel 1. In this way, the load 4 can be lowered or lifted, and heave compensation can be provided. In this example, the load 4 is suspended from a wire rope 5 which runs over a sheave mounted on an upper end of the actuator.

The hoisting rig 3 and the load 4 may take many different forms in practice. The hoisting rig 3 may for example include a derrick on a drilling vessel or platform from which a load 4 in the form of well equipment such as a drill string is supported via the actuator 6. In such a variant, the actuator has several vertical hydraulic cylinders which are typically utilised in parallel with several wire ropes running over sheaves in a crown block for the necessary support of the load. In such a case, the hoisting rig 3 and the actuator 6 can assist during trips in or out of a wellbore. In such a process, the equipment is suspended and held in position from the hydraulic actuator 6 on the vessel while a section of the string is inserted or replaced, and the actuator is then used to lower or lift the equipment before the next section is to be inserted or replaced.

In some cases, the load 4 may be connected to the seabed, such as when the load 4 may be a riser which is attached to a subsea wellhead. The actuator 6 may then be used to support the load 4 to apply a certain tension to the riser. In the case of the drill string, during drilling, the actuator 6 may also be used to apply tension or otherwise provide an appropriate supporting force on the drill string for applying the drill bit in the wellbore with a constant weight against an end of the wellbore.

When heave compensation takes place, the system 10 operates to maintain the load 4 in a predetermined position or to follow a predetermined movement in space independent of the motion of the vessel 1. The actuator 6 may then operate, e.g. extend or retract, to keep the load 4 in that position or support the load accordingly. Lowering or lifting of the load 4 can in principle take place without heave compensation, but in many applications it will be desirable to provide heave compensation during lowering or lifting for example to ensure that the load is handled safely and predictably without heave affecting the lowering or lifting conditions.

It can thus be appreciated that the hydraulic actuator 4 (typically the main lifting cylinder or cylinders of a cylinder hoisting rig) supports the load 4 from the vessel. By way of the extension or retraction of the actuator 6 (e.g. a cylinder piston rod), the actuator 6 allows for compensation of the heave motion of the vessel 1 and can simultaneously apply a force to the load 4 e.g. to lift, lower, or position the load 4 or adjust a tension on the load 4 (e.g. when the load is connected to the seabed).

The hydraulic actuator 6 is operated by hydraulic fluid, e.g. hydraulic oil. The hydraulic fluid is supplied to the actuator 6 with the required power in order for the actuator 6 to operate to extend or retract to perform its function in lifting, lowering, positioning, or providing tension on the load, and/or providing heave compensation.

Figure 2:
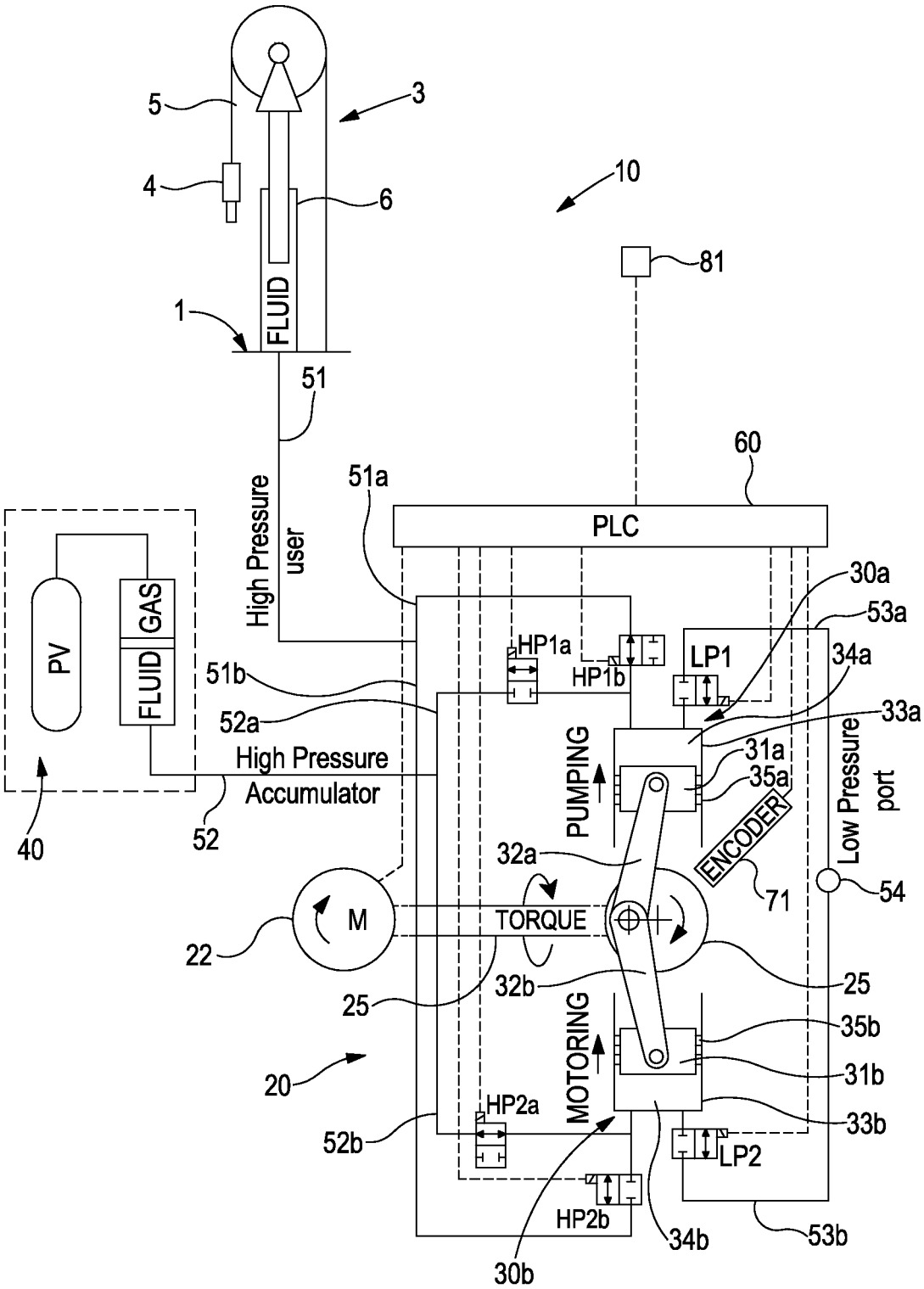
FIG. 2 is a schematic representation of the system of FIG. 1, in greater detail.

Referring additionally to FIG. 2, it can be seen that the system 10 includes a hydraulic accumulator 40. The hydraulic accumulator 40 can be charged to store energy.

The hydraulic fluid is supplied in this system by means of a machine comprising a hydraulic transformer 20, as seen in FIG. 2. The transformer 20 includes hydraulic pump/motors 30*a*, 30*b* which are connected to a rotatable shaft 25. In addition, a power source in the form of an electric motor 22 is coupled to the shaft 25.

Rotation of the shaft about its long axis may be driven by operation of the electric motor 22 and/or by one or more of the pump/motors 30*a*, 30*b*. Charging of the accumulator 40 may take place for instance during a period in which energy can be recovered from the actuator 6 for instance during lowering of a load 4. It may also take place by applying the electric motor 22 to charge the accumulator 40 when the actuator 6 is in "standby" mode (when not being used for lifting or lowering).

In general, the hydraulic transformer 20 provides for energy to be transferred between respective components of the actuator 6, hydraulic accumulator 40, and the electric motor 22 in both directions. Hence, the transformer 20 for instance operates not only to supply fluid to the actuator 6, but may also be configured to use energy from the actuator 6 e.g. if compressed under the load 4 upon lowering or in a heave upward motion, to charge the accumulator 40. The transformer 20 controls communication of hydraulic fluid in the system and provides for operating the actuator 6 in the necessary manner.

The pump/motors 30*a*, 30*b* each has a drive chamber 34*a*, 34*b* for hydraulic fluid, and has number of switchable valves HP1*a*, HP1*b*, LP1, HP2*a*, HP2*b*, LP2 associated with it. The valves HP1*a*, HP1*b*, LP1, HP2*a*, HP2*b*, LP2 are switchable during a cycle of the pump/motor 30*a*, 30*b* for selectively providing (or preventing) fluid communication between the drive chamber of the pump/motor 30*a*, 30*b* and any of the actuator 6, the accumulator 40, and a fluid reservoir 54. By appropriately switching the valves HP1*a*, HP1*b*, LP1, HP2*a*, HP2*b*, LP2, a desired displacement of hydraulic fluid from the pump/motor 30*a*, 30*b* can be obtained, as may for instance be needed for supplying the actuator 6 with the hydraulic power for performing one of its functions or for charging the accumulator 40. The "HP" denoted valves are for connection to high pressure users (the accumulator and the actuator), while the "LP" denoted valves are for connection to low pressure, i.e. low-pressure reservoir for hydraulic fluid.

Each of the pump/motors 30*a*, 30*b* has fixed stroke lengths, and each is configured for being able to perform both motoring and pumping. During pumping, the pump/motor 30*a*, 30*b* is driven via the drive shaft 25 to pump fluid e.g. for powering the hydraulic actuator 6 and/or charging the accumulator 40. During motoring, the pump/motor 30*a*, 30*b* applies torque to the drive shaft 25, driven by the accumulator 40 and/or the hydraulic actuator 6 to rotate the shaft 25.

Pumping and motoring is performed in different strokes of the cycle of the pump/motor, and may be performed, by appropriate switching of the valves, only during a part of the stroke in that cycle. In one revolution of the shaft, the pump/motor performs one such cycle. In general, where there are several such pump/motors in the transformer, they may be switched differently, so that a desired combined performance in the transfer of energy amongst the accumulator, actuator, and the power source can be obtained from the pump/motors.

The strokes in which pumping may occur are referred to herein as "pump strokes", and the strokes in which motoring may occur are referred to as "motor strokes".

In either or both of the pump and motor strokes, fluid may be routed from the pump/motor 30*a*, 30*b* to the reservoir 54.

Rotation of drive shaft produced for example by motoring of the pump/motor, may be applied to generate electrical energy.

The operation of the system is controlled through use of a controller 60. The valves of the pump/motors 30*a*, 30*b* are operated under control from the controller 60. The controller 60 may pass instructions to the valves HP1*a*, HP1*b*, LP1, HP2*a*, HP2*b*, LP2 for operating the valves in the manner needed e.g. to control the pump/motors 30*a*, 30*b* to perform pumping and/or motoring to obtain the desired displacement of hydraulic fluid.

The controller 60 operates according to obtained data input e.g. from manual controls or from sensors, in order to control the actuator 6 to perform as desired.

Thus, the system 10 may operate to control the actuator 6 and recover energy when providing compensation and/or functions of lifting, lowering, tensioning and/or positioning the load.

It can be noted that the hydraulic accumulator 40 may comprise a tank containing compressible gas such as nitrogen which is compressible so as to charge the accumulator by fluid force exerted on a movable hydraulic interface between the gas and the hydraulic fluid communicated from the actuator 6. Via the transformer 20, the accumulator 40 may be charged for instance when the actuator 6 is compressed during lowering of a load and energy can be recovered.

In one particular control example, the machine is utilised to charge the accumulator 40 during periods when waiting to perform lifting operations. This may be typical in a tripping operation, while the load of the drill string is held at a standstill during removal of a drill string section. During the waiting time, the electric motor 22 may continue to run to turn the drive shaft 25 and charge the accumulator 40 via the pump/motors 30*a*, 30*b*. When lifting is required, stored energy in the accumulator 40 may be applied to assist with the lift. By utilising the waiting time to charge the accumulator 40 by means of the electric motor 22, the installed capacity of the motor 22 may be reduced compared with typical practice in today's offshore hoisting rigs. For example, instead of applying a motor operating at 10 MW for a short period of time for lifting, a motor for instance operating at 2 MW over a longer period can be used, by charging in the wait periods, to obtain the same lifting power. The overall installed motor power can therefore be reduced, and space, cost and fuel consumption savings can be made.

Considering now FIG. 2 in more detail, the pump/motors 30*a*, 30*b* have respective pistons 31*a*, 31*b* which are connected to the drive shaft 25 by coupling rods 32*a*, 32*b*. One end of each coupling rod 32*a*, 32*b* is mounted in an eccentric position to the drive shaft 25 and the other end is connected to the head of the respective piston 31*a*, 31*b*. As the drive shaft 25 turns, the pistons 31*a*, 31*b* are moved reciprocally back and forth inside piston housings 33*a*, 33*b* dependent upon the rotational position of the drive shaft 25.

As can be seen, each piston 31*a*, 31*b* is movably mounted in the piston housings 33*a*, 33*b*, with drive chambers 34*a*, 34*b* defined between the respective drive surfaces piston 31*a*, 31*b* and inner wall surfaces of the housings 33*a*, 33*b*. Seals 35*a*, 35*b* are provided between the piston and the inner wall of surfaces of the housings 33*a*, 33*b* so as to prevent undesired fluid leakage from the chambers 34*a*, 34*b* across the seals. Upon rotation of the drive shaft 25, the pistons move inside the respective housings and the drive chambers 34*a*, 34*b* reduce or increase in size accordingly.

The transformer 20 in this example is arranged so that both pistons 31*a*, 31*b* are able to be actively utilised to perform work both during an outbound, pump stroke and during an inbound, motor stroke. For each full turn of the drive shaft 25 in this example, each piston completes one cycle of movement comprising the outbound, pump stroke and the inbound, or return, motor stroke.

FIG. 2 illustrates an instance during use of the machine where the piston 31*a* is pumping in the pump stroke and the piston 31*b* is motoring in the motor stroke.

As can be seen, in the motor stroke of the piston 31*b* (during motoring), the accumulator 40 is in fluid communication with the transformer to drive the piston 31*b* to add torque to the drive shaft 25. The accumulator 40 operates to urge hydraulic fluid in the drive chamber 34*b* to exert a drive force on the piston 31*b*. This force is transmitted to the drive shaft 25 via the coupling rod 32*b* to apply a component of torque to the drive shaft 25.

In the pump stroke of the piston 31*a* (during pumping), hydraulic fluid in the chamber 33*a* is pumped out of the chamber. The piston 31*a* is driven by the drive shaft 25 and the drive surface of the piston 31*a* exerts a force on the fluid in the drive chamber 34*a* so that fluid is expelled from the chamber. The actuator 6 is in fluid communication with the piston 31*a* so that the piston 31*a* operates to pump fluid into a drive chamber of the hydraulic actuator 6. By doing so, the load 4 can be lifted by the hydraulic actuator 6 relative to the vessel to compensate for heave motion or to perform general lifting. In other instances, in the pump stroke, the accumulator 40 may be charged.

The electric motor 22 operates to provide and make up any shortfalls in energy, e.g. due to losses in the system. As explained elsewhere, this can in general be during periods of standstill to charge the accumulator, but also during periods of lifting, to facilitate provision of the required lifting power. When operational in the context of FIG. 2, the electric motor 22 can for instance apply a further component of torque to the drive shaft 25 for helping to drive the piston 31*a* through the pump stroke.

Since the same piston 31*a*, 31*b* in both the inbound and outbound strokes of the movement cycle of the pump/motors 30*a*, 30*b* is used to transmit energy and perform effective work, the number of components in the transformer 20 may be reduced in comparison with typical prior art machines for operating hydraulic heave compensating actuators in active/ passive heave compensation systems or hoisting rigs on vessels. Accordingly, the size and amount of materials of the machinery may also be reduced and transmission of energy may be more efficient due to reduced number of working components and reduced frictional losses in the system.

To achieve this functionality, the respective drive chambers 34*a*, 34*b* are arranged to be selectively placed in fluid communication with either the actuator 6 or the accumulator 40 through the operation of valves HP1*a*, HP1*b*, LP1, HP2*a*, HP2*b*, LP2. Each drive chamber 34*a*, 34*b* is connectable via a first fluid line including a first flow valve to the actuator 6, or via a second fluid line including a second flow valve to the accumulator 40. By switching the first or second valves to permit or prevent fluid flow therethrough, the required fluid communication with either the accumulator 40 or the actuator 6 can be provided. The valves are operated to switch by actuation signals transmitted to the valve. This functionality as applicable to the example configuration illustrated in FIG. 2 is described further in the following.

In FIG. 2, the drive chamber 34*a* is in fluid communication with a hydraulic chamber of the actuator 6 via a fluid line 51*a*. A flow valve HP1*b* is arranged in a fluid line 51*a* between the drive chamber 34*a* and the actuator 6 and is switched to an open position so as to let fluid communicate through the valve HP1*b* between the machine and the actuator 6. Hydraulic fluid can thus be pumped into the actuator 6 by operation of the piston 31*a*.

Another fluid line 51*b* is provided for connecting the actuator 6 to the second drive chamber 34*b* with a flow valve HP2*b* in the fluid line 51*b*. In FIG. 2 however, the valve HP2*b* is closed, so that there is only fluid communication through the valve HP1*b* between the actuator 6 and the drive chamber 34*a*.

The drive chamber 34*b* is in fluid communication with the accumulator 40 through a fluid line 52*b*. A flow valve HP2*a* is arranged in the fluid line 52*b* and is in an open position to provide fluid communication through the line 52*b* and the valve HP2*a*.

Another fluid line 52*a* is provided for connecting the actuator 6 to the second piston 31*b* with a flow valve HP1*a* in the fluid line 52*a*. In FIG. 2 however, the valve HP1*a* is closed, so that fluid communication only takes place through the valve HP2*a* between the accumulator 40 and the drive chamber 34*b*.

As the drive shaft 25 is rotated further beyond the position indicated in FIG. 2, e.g. to its 180 degree opposite position, it can be appreciated that the pistons 31*a*, 31*b* move in the opposite direction to that indicated in FIG. 2. The piston 31*a* then performs an inbound, motor stroke and the piston 31*b* then performs an outbound, pump stroke. When motoring and pumping in the respective motor and pump strokes, the flow valves HP1*a*, HP1*b*, HP2*a*, and HP2*b* will then all be switched to their opposite configuration. That is, valve HP2*a* is closed and valve HP1*a* is open to provide communication through the valve HP1*a* in the line 52*a* between the accumulator 40 and the drive chamber 34*a*. And, valve HP1*b* is closed and valve HP2*b* is open to provide communication through the valve HP2*b* between the drive chamber 34*b* and the actuator 6.

The valves LP1 and LP2 are provided for selectively connecting the drive chambers 34*a*, 34*b* to a low pressure reservoir 54 (e.g. in a feed circuit). Importantly, this allows fluid to be routed from a drive chamber 34*a*, 34*b* to the low pressure reservoir 54 depending for instance upon output requirements, e.g. the flow needed for the actuator. It may allow a particular pump/motor to idle with the drive shaft turning, where the chambers fill and dispose of fluid to the reservoir, but neither consumes power from the accumulator 40 nor contributes to generating power for the actuator 6. By opening the low pressure valve and closing the high pressure valves, the piston can be "disabled" in terms of contributing to the displacement and can simply idle without being pressurised (above reservoir pressure). This facilitates obtaining the required fluid displacement and flow from the pump/motors of the transformer. As can be seen, the valve LP1 is provided in a fluid line 53*a* between the drive chamber 34*a* and the low pressure reservoir 54. The valve LP1 in the instance of FIG. 2 is shown in closed position, but can be switched to an open position to provide communication through the line 53*a* between the drive chamber 31*a* and the low pressure reservoir 54. In a corresponding manner, the valve LP2 in FIG. 2 is also shown in closed position, but can be switched to an open position to provide fluid communication through the line 53*b* between the drive chamber 31*b* and the low pressure reservoir 54.

It can be appreciated that during operation of the transformer in practice, only one of the valves in the set HP1*a*, HP1*b*, LP1 of the pump/motor 30*a* will be open. Similarly for the pump/motor 30*b*, only one of the valves in the set HP2*a*, HP2*b*, LP2 will be open during operation of the transformer. If both HP valves in either set are closed, the LP valve will be open.

The pistons 31*a*, 31*b* perform fixed-length linear strokes. The total length of the stroke both inbound and outbound is the same each time with rotation of the shaft 25. The arrangement of valves provides for controlling the fluid flow for obtaining a desired output e.g. in terms of flow for the hydraulic actuator 6, and optimising for utilising and recovering energy. Multiple pump/motors may be utilised providing several options for routing hydraulic fluid to provide suitable output. For example in a situation where pressure is higher in the accumulator than in the actuator, some of the motoring strokes may be routed to the reservoir 54 to balance the difference in pressure while the electric motor is idling.

It will be appreciated also that one or more of the valves HP1*a*, HP1*b*, LP1, HP2*a*, HP2*b*, LP may be switched mid-stroke, or in a certain percentage of pump/motor strokes, to provide the necessary output from the machine. In general, any number of ports in the respective drive chambers may be provided for fluid communication with the actuator, accumulator, or reservoir. The ports may be activated for routing flow as required, by switching of valves on the fluid lines connecting to those ports. Under certain conditions, such as when being driven by the accumulator and the actuator demand is met, the turning of the shaft 25 may generate electricity in the motor, the motor in effect acting as an electrical generator.

The transformer 20 is controllable digitally through a computer device in the form of programmable logic controller (PLC) 60. The valves HP1*a*, HP1*b*, HP2*a*, HP2*b*, LP1, LP2 are operated digitally through instructions transmitted from the PLC 60, for placing the relevant valve in the open or closed position in order to achieve the necessary communication of fluid between the drive chambers and the accumulator 40, the actuator 6, and/or the reservoir 54.

The transformer 20 includes an encoder 71 which is configured to detect the status of the machine, in particular to identify the position of the drive shaft 25 and/or pistons 31*a*, 31*b* in the cycle. Based on the data from the encoder, the valves HP1*a*, HP1*b*, HP2*a*, HP2*b*, LP1, LP2 may be switched appropriately. In practice, the PLC 60 may use the data from the encoder 71 and issue switching signals for switching based on that data.

In one example, the transformer 20 is operated based on the heave conditions of the vessel, and a motion sensor 81 is provided to detect heave motion. Using data from the motion sensor 81, the necessary output from the machine 70 for actuating the actuator 6 e.g. to cancel the effect of heave motion on the load 4, can be determined e.g. via a computer program pre-stored in memory in the PLC 60. The valves HP1*a*, HP1*b*, HP2*a*, HP2*b*, LP1, LP2 can be opened and closed accordingly. The PLC 60 may also control the operation of the motor 22 as required. In one example, the transformer may be operated so that the motor 22 has a constant power output over different lifting cycles, e.g. so that motor operates with a smaller amplitude variation in power than the amplitude variation in power applied to or required by the actuator, e.g. when heave compensating and/or lifting. In other variants, the transformer may typically be controlled also using other inputs, such as for instance operator inputs, data from pressure sensors (e.g. for detecting the pressure of hydraulic lines, actuator and/or accumulator), position sensors, data from the power management system on the vessel, or load cells as may be applied to detect the tension to which the load is subjected (e.g. where the load is a riser or tubing requiring tension).

In certain cases, the PLC may be supplemented with a fast embedded controller for performing the switching of the valves. In such a case, a PLC may perform a 'high-level' part of the control algorithm, and typically decide on the required displacement (in %, as a ratio of a maximum, e.g. with all pump/motors pumping full stroke). The fast embedded controller would then decide on whether to open or close the valves to achieve the desired displacement ratio.

As mentioned above, it may be typical in other embodiments for one or more further pump/motors to be coupled to the drive shaft 25, in the same manner as the pistons 31*a*, 31*b*, to provide the necessary output of hydraulic fluid from the machine for pumping fluid into the actuator 6. In order to obtain a desired displacement or flow, one way may be to select a discrete number of the pistons to be enabled or disabled, e.g. 50% of the pistons are enabled for a 50% displacement (relative to the maximum possible). Hence, outputs from several different pistons may be combined to provide an output of fluid as necessary for actuating the actuator 6 appropriately. Alternatively, or in addition, individual pistons may be enabled for pumping for part of the strokes to further control the combined displacement obtained from the pump/motors.

Some operational modes are now described with further reference to FIGS. 3 to 7.

Figure 3:
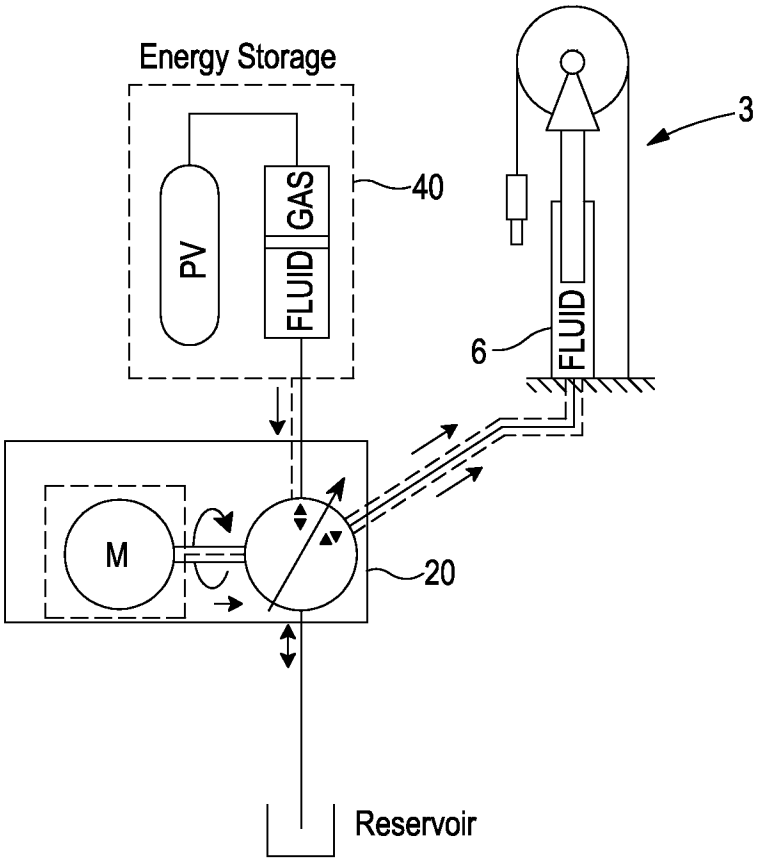

FIG. 3 illustrates a situation where the hoist has a high energy demand for example to perform hoisting or to compensate for a heave downward motion, requiring the actuator 6 on the vessel to be stroked out significantly against the force of the load. The transformer 20 is utilised as indicated in FIG. 2, to pump fluid into the actuator 6 by use of both the stored energy from the accumulator and energy applied from the electric motor to turn the drive shaft 25.

Figure 4:
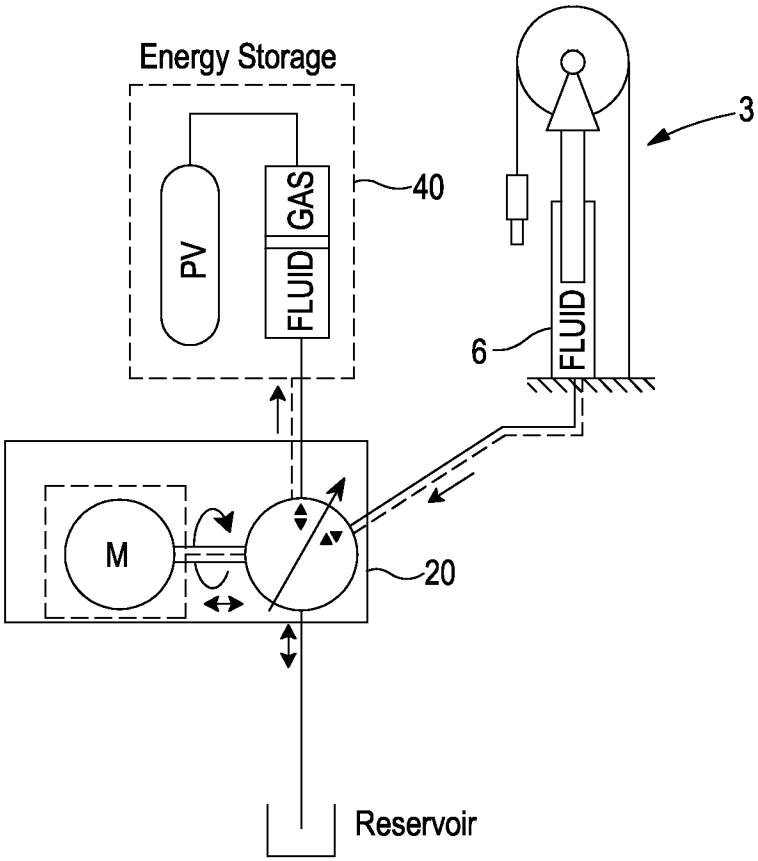
FIGS. 3 to 7 are schematic representations of different operational modes obtainable by the system.

In FIG. 4, in contrast, a situation of low demand is shown, for example when lowering the load or during an upward heave motion, where the actuator 6 may be allowed to retract under the weight of the load 4. In this case, the fluid may be driven from the actuator by the load and transmitted through the transformer 20 to charge the accumulator. The valves HP1*a*, HP1*b*, HP2*a*, HP2*b* may then be set in their opposite states to that shown in FIG. 2 with the actuator used for motoring, so that the accumulator is charged by pumping fluid from the chamber 34*a*.

Figure 5:
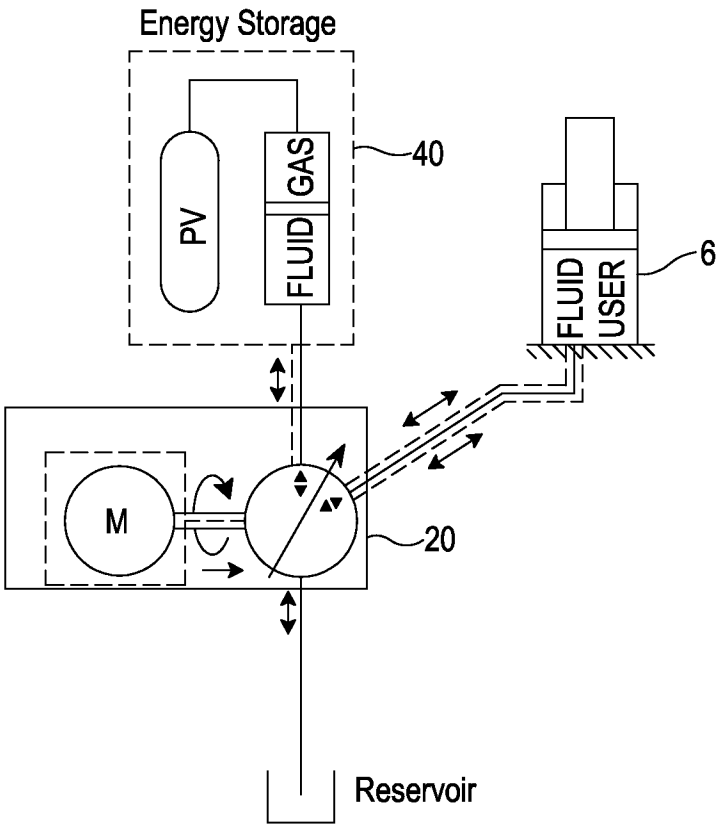

FIG. 5 shows the general situation where fluctuations in heave may be taking place cyclically with the waves over time, and the transformer 20 operates sometimes to provide the high energy demand for hoisting, making use of the electric motor 22 to supplement energy from the accumulator 40 if appropriate, and other times for charging the accumulator 40. When performing heave compensation in this manner, the transformer 20 is operated to make the power consumption of the motor practically constant over time. The power on the cylinder due to heave may for example approximate a sine wave with an amplitude of 5 MW, while the motor may for example keep a constant power of 0.5 MW in order to compensate for losses. As mentioned elsewhere above, the motor may also charge the accumulator running at the same power during pauses between lifting operations, not only to overcome losses, but also so that the necessary power is available in the charged accumulator for lifting operation.

Figure 6:
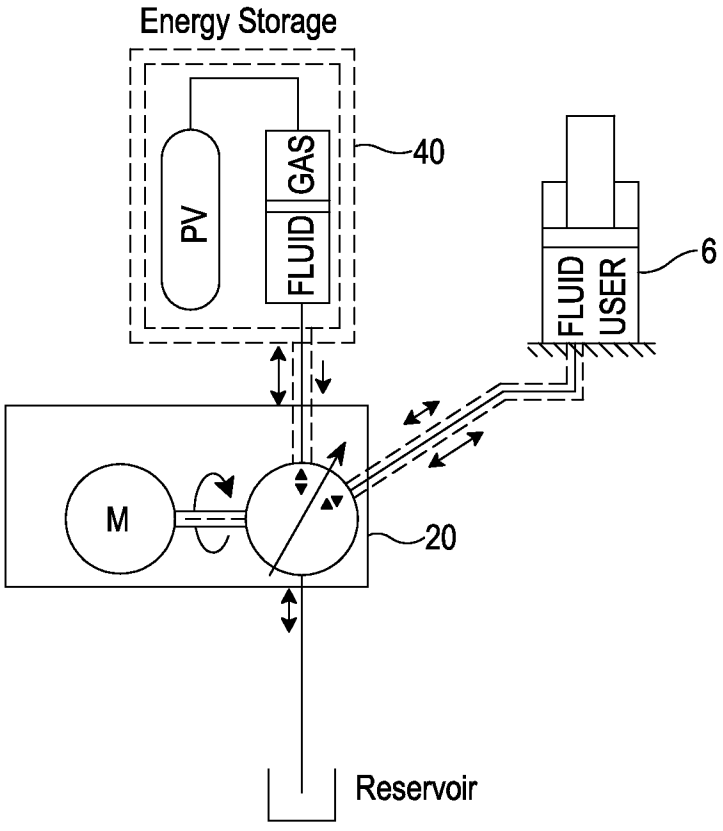

FIG. 6 illustrates a passive mode, where all of the energy necessary for actuating the actuator 6 comes from the accumulator 40, through the transformer 20, and when energy demand is low the actuator charges the accumulator via the transformer 20. Heave compensation may then be achieved using the energy from the accumulator until this becomes insufficient through system losses due to friction, heat, etc. This can be useful for example in the event that the load is a riser which is attached to the seabed or another tubing requiring tension, where the hydraulic actuator is used to apply tension to the riser or tubing. In order to provide compensation and obtain tension, one could reduce the performance in that some variation in the tension may be permitted, e.g. an increase the tension when compensating for the vessel's heave upward motion, a decrease in tension when compensating for the vessel's heave downward motion. This way, the level of the accumulator has a time average constant (as it never empties but only cycles passively between discharge and charge) without external power input from the electric motor, indefinitely.

Figure 7:
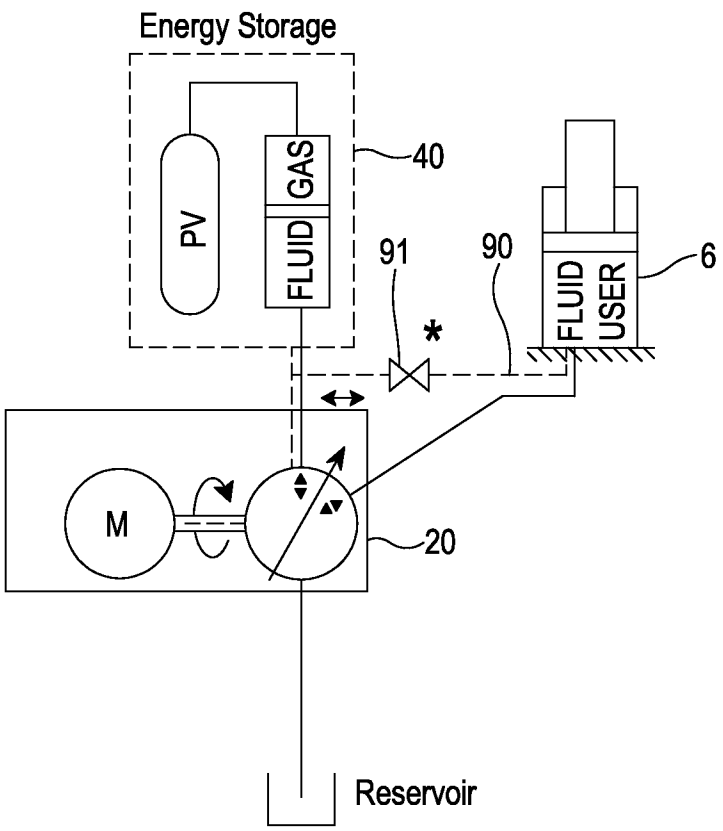

FIG. 7 illustrates a further "pure" passive mode, where in the event of loss of power to the machine 20 e.g. so that valves in the transformer 20 cannot be controlled, communication between the actuator 6 and the accumulator 60 is obtained through a direct connection fluid line 90 providing direct fluid connection by opening of the valve 91 in the fluid line 90. With this short-circuit, the system can compensate indefinitely. In applying the system to obtain tension on a load, losses will then be seen as tension variation.

The requirements of the actuator for providing the necessary manipulation of the load and/or heave compensation are determined in the system, e.g. calculated by the controller on an ongoing basis and based on received data, e.g. measured heave, position of the load, user-control inputs, etc, and the instructions for operating the machine issued accordingly. The controller may also be provided with an algorithm for determining how the transformer 20 should distribute power and communicate hydraulically through the pump/motors between and amongst the accumulator 50, the actuator 6, and the motor 22, e.g. to operate the actuator to compensate for heave. The modes illustrated in FIGS. 3 to 7 represent some typical modes indicating how energy may be distributed and communicated via the system 10.

Use of the hydraulic transformer based on pump/motors as described above potentially can provide numerous advantages to the system. By using each piston both as a pump and as a motor (to add torque to the drive shaft from the accumulator or actuator) when not pumping, componentry in the system can be reduced. This provides for an efficient use of space as the machine can be made more compact.

Moreover, "digital" pump/motors of the type described which are switched to obtain the required displacement can improve the energy efficiency of the system and can reduce the overall footprint, compared with typical prior art hoisting rig proposals with traditional axial-piston pumps. Pump/motors with switchable valves to control the displacement can reduce losses and can be fundamentally more efficient than traditional axial piston units.

The hydraulic transformer proposed allows free exchange of power and energy between cylinders and the accumulator regardless of the pressure differences therebetween. For instance, a higher pressure in the accumulator than in the actuator is not required in order to utilise the energy in the accumulator. The minimum usable accumulator pressure is lowered such that the usable volume of a given accumulator bank, and the usable energy, can be increased. If for instance there is higher pressure in the accumulator than in the actuator cylinder, the differential pressure would not be lost but rather can simply be transformed to higher flow, as the transformer operates to satisfy closely conversion of high pressure/low flow to low pressure/high flow, i.e. $p_1*Q_1=p_2*Q_2$, energy being conserved. Energy in the accumulator can therefore be better utilised. In certain cases, fewer accumulators could be installed for the same available energy. The transformer allows for energy recovery during lowering in all scenarios independent of the system pressure.

Boost and dump valves which are typically employed in today's cylinder hoisting rigs can be removed and the associated principal losses avoided, since in the present solution all flow between accumulator and the actuator can run through the hydraulic transformer. Heave compensation may also take place on the main hoisting actuator 6, as described above, without requiring the deadline compensator typically employed in prior art systems. The accumulator can store energy during heave while the motor may only be required to supply sufficient power to compensate for losses.

When hoisting (or during heave downward), the energy in the accumulator relieves the electric motor by supplying torque to the common shaft 25. When lowering (or during heave upward), power from the actuator 6 fills the accumulator 40, rather than being taken up by the electric motor and dissipated over brake resistors. Thus, a free exchange of energy and power between lifting cylinders (i.e. the actuator 6), the accumulator 40, and the electric motor 22 can be obtained regardless of system pressure.

Through the use of the present transformer, a control strategy can be employed where the power draw from the motor is kept constant during an operation, e.g. a lifting sequence where there are highly varying power demands on the actuator for lifting, lowering, heave compensating etc., over a period of time. While the transformer is kept at a certain velocity by the electric motor, the valves on the pump/motors can simply be switched for the pump/motors to deliver the necessary flow to the actuator as and when required. In other variants, it may be advantageous to vary the speed somewhat (e.g. using a variable frequency device VFD to control the electric motor). Since in a typical tripping scenario the lifting is intermittent, the pauses between lifting phases can be utilised to charge the accumulator to obtain the necessary power in the system with the motor running at a relatively low power. This means that the installed maximum power of the electric motor, associated cost and fuel consumption may be reduced, and that electric motor may run closer to optimal efficiency.

The presently described solution may thus provide a feasible, low-footprint, cost and energy efficient system for a hoisting rig on an offshore platform or vessel.

Various modifications and improvements may be made without departing from the scope of the disclosure herein described.

The invention claimed is:

1. A system arranged on a marine vessel or platform, the system comprising:

at least one hydraulic actuator coupled to a load, the actuator being configured to support the load while allowing compensation for the heave motion of the marine vessel or the platform in the sea, the load being supported via the hydraulic actuator from the marine vessel or platform;

at least one hydraulic accumulator;

at least one reservoir for hydraulic fluid;

at least one controller;

a transformer comprising at least one power source and at least one hydraulic pump/motor, for communicating energy between any two of the hydraulic actuator, the accumulator, and the power source; and at least one valve associated with the pump/motor, the valve being switchable during at least one cycle of the pump/motor for selectively providing fluid communication between a drive chamber of the pump/motor and any of the hydraulic actuator, the hydraulic accumulator, and the reservoir, via at least one port of the drive chamber, so as to allow a desired displacement of hydraulic fluid from the pump/motor to be obtained;

the valve being operable under control from the controller.

2. A system as claimed in claim 1, wherein the valve is selectively operated to enable motoring, wherein the pump/motor is driven by either or both of the accumulator and the hydraulic actuator to apply a component of torque to a drive shaft for facilitating rotation of the drive shaft.

3. A system as claimed in claim 2, wherein the pump/motor when motoring is driven by the hydraulic actuator, in an energy recovery condition, in response to lowering the load, reducing tension on the load, and/or heave upward motion.

4. A system as claimed in claim 1 wherein the valve is selectively operated to enable pumping, wherein the pump/motor is driven to pump fluid for either or both of actuating the hydraulic actuator and charging the accumulator.

5. A system as claimed in claim 4, wherein the pump/motor when pumping is performed to provide the hydraulic actuator with power to operate the hydraulic actuator for lifting the load, applying tension to the load, and/or compensating for heave downward motion.

6. A system as claimed in claim 4, wherein the pump/motor is driven by the power source and/or another pump/motor.

7. A system as claimed in claim 6, wherein the pump/motor is driven via a rotatable shaft through which the power source and the pump/motors are coupled.

8. A system as claimed in claim 4, wherein the pump/motor when pumping is driven by the power source to charge the accumulator during a pause between lifting operations in which sections of a pipe string are removed or added in a tripping in or out process.

9. A system as claimed in claim 8, wherein the power source operates at a constant level of power between the pause and the lifting operations, the energy in the charged accumulator being applied together with the energy from the power source to pump fluid during the lifting operations in order to obtain the required power for the actuator to perform the lifting.

10. A system as claimed in claim 1, wherein the valve is selectively operated to operate the pump/motor to circulate fluid between the reservoir and the drive chamber in an idle mode.

11. A system as claimed in claim 1, wherein the pump/motor has a cycle comprising first and second strokes, wherein motoring can take place in the first stroke and pumping can take place in the second stroke.

12. A system as claimed in claim 11 wherein the valve may be operated to produce pumping in part of the second stroke to obtain the desired fluid displacement and/or to provide motoring in part of the first stroke.

13. A system as claimed in claim 11, wherein the pump/motor comprises at least one reciprocating piston which travels in a fixed-length linear stroke in each and every cycle.

14. A system as claimed in claim 1, wherein a plurality of pump/motors are coupled to a shaft which cooperate to produce a desired fluid displacement wherein at least one valve is selectively operated to provide fluid communication between the accumulator, the reservoir, or the hydraulic actuator and the drive chamber of any one or more of the plurality of pump/motors for obtaining said desired displacement.

15. A system as claimed in claim 14, wherein the valve is operated to enable or disable any one or more of the pump/motors to obtain the desired fluid displacement from the plurality.

16. A system as claimed in claim 1, which further comprises:

a first line for fluid communication between the actuator and the drive chamber of the pump/motor;

a second fluid line for fluid communication between the energy storage device and the drive chamber;

a third fluid line for fluid communication between the drive chamber and the reservoir; and wherein the valve is switchable for selectively putting any one or more of the first, second, and third fluid lines in fluid communication with the drive chamber.

17. A system as claimed in claim 16, wherein by switching the valve fluid communication through the first, second and/or third fluid lines is opened or closed.

18. A system as claimed in claim 1, wherein the switchable valve is operated to switch during the stroke or between end points of fixed-length first and/or second strokes of the pump/motor.

19. A system as claimed in claim 1, wherein the power source comprises an electric motor.

20. A system as claimed in claim 1, wherein rotation of the shaft during motoring generates electricity in the motor.

21. A system as claimed in claim 1, wherein the pump/motor comprises at least one piston movably mounted in a piston housing, so as to be movable reciprocally back and forth within the housing.

22. A system as claimed in claim 1, further comprising at least one sensor, the controller being adapted to operate based on received data from the sensor for passing an instruction to the valve for controlling the pump/motor.

23. A system as claimed in claim 22, wherein the sensor is selected from any of: a load-cell for detecting tension imparted to the load; a position sensor for detecting a position of the load; a heave motion sensor for detecting the heave motion of the vessel; an encoder for detecting a rotational position of the drive shaft.

24. A method of supporting a load from a vessel or platform using the system as claimed in claim 1.

25. The system of claim 1, wherein the transformer is configured to communicate energy between the hydraulic actuator and the accumulator and/or the power source.

* * * * *